United States Patent [19]

Chaudot

[11] Patent Number: 4,547,149

[45] Date of Patent: Oct. 15, 1985

[54] SYSTEM FOR PREVENTING LIQUIDS FROM BEING DRIVEN TO THE FLAIR STACK TIP

[76] Inventor: Gerard Chaudot, 14, Allee de La Rochefoucauld, Andresy 78570, France

[21] Appl. No.: 506,647

[22] PCT Filed: Sep. 23, 1982

[86] PCT No.: PCT/FR82/00156

§ 371 Date: May 23, 1983

§ 102(e) Date: May 23, 1983

[87] PCT Pub. No.: WO83/01086

PCT Pub. Date: Mar. 31, 1983

[30] Foreign Application Priority Data

Sep. 23, 1981 [FR] France ..... 81 17969

[51] Int. Cl.[4] ..... F23D 13/10

[52] U.S. Cl. ..... 431/202; 166/357; 166/363; 166/267; 55/421; 431/117

[58] Field of Search ..... 431/202, 117, 118, 65; 239/124; 114/232; 175/7; 166/357, 363, 267; 137/236 S, 312, 565, 587, 589; 55/212, 227, 421

[56] References Cited

U.S. PATENT DOCUMENTS

| | | | |
|---|---|---|---|
| 1,567,815 | 12/1925 | Ravenor | 431/118 X |
| 3,875,998 | 4/1975 | Charpentier | 166/357 |
| 3,881,549 | 5/1975 | Thomas | 166/357 |

*Primary Examiner*—Randall L. Green

*Attorney, Agent, or Firm*—Scully, Scott, Murphy & Presser

[57] ABSTRACT

A safety system for eliminating the risk of liquids, rather than gases, being carried to a torch nose-piece or to a vent hole, during burning or dispersion of the gases associated with the production or treatment of hydrocarbons, particularly on off-shore installations. The gas flow line is connected to a storage volume or capacity, such as a torch foot tank. An overflow column is also connected to the gas flow line, and discharges below a liquid level, such as for example the sea, at a distance from the connection to the overflow column.

10 Claims, 3 Drawing Figures

SYSTEM FOR PREVENTING LIQUIDS FROM BEING DRIVEN TO THE FLAIR STACK TIP

BACKGROUND OF THE INVENTION

The present invention relates generally to a safety system for eliminating any risk of liquids being carried to the torch nose-piece or to the vent hole, during burning or dispersion of the gases associated with the production or with the treatment of hydrocarbons on land and off-shore.

The present invention relates to a safety system for eliminating any risk of liquids being carried to the torch nose-piece during burning of the gases associated with the production of hydrocarbons, more especially off-shore.

Generally, it is known that liquids carried along in the nose-piece of a torch, particularly resulting from choking up of the gas/oil or gas/condensate separators, constitutes a serious danger in hydrocarbon treatment and production installations and in particular in fixed or floating off-shore production installations.

In fact, on leaving the nose-piece of the torch, the oil or the condensates carried along by the gas are set on fire and fall flaming back down on to the installation or in the immediate vicinity thereof, thus endangering the whole installation and the lives of the whole of the staff.

This danger is all the more important, in off-shore installations, since the staff risk being imprisoned on the platform or the floating burning support and since further the oil or the condensate floating on the sea may form a sheet of fire prohibiting any possibility of evacuation.

To try to eliminate this risk, one of the best arrangements used up to present is formed by placing, between the liquid hydrocarbon driving source and the nose-piece of the torch, three capacities, namely a separator, a safety purifying installation and a torch foot tank, mounted in series in the gas flow chain, these capacities being respectively equipped with three high level detection devices which cause, should the liquid level exceed a predetermined height, closure of the hydrocarbon feed of the installation.

Furthermore, in such an installation, the torch foot tank has, or may have, a liquid retention capacity, such that it allows sufficient time for the hydrocarbon feed valves of the installation to be closed manually.

However, it is clear that in any case, principally in the case where the torch is vertical or subvertical on the production support, the safety of the staff and of the whole of the platform will depend:

on the operation of the automatic detection and mechanical actuation automatic devices which are always subject in time and depending on the operating conditions to break-downs, and as a last resort, on the time in which the liquid is retained in the torch foot tank, which is dimensioned with respect to the anticipated duration of human intervention, which is always problematic and the hazardous character of which does not conform to good safety logic.

Furthermore, it should also be noted that the torch foot tank, which is generally placed in a low part of the installation, because of its dimensions risks causing considerable, even inacceptable inconvenience.

SUMMARY OF THE INVENTION

The invention has then as its aim to do away with all these disadvantages.

It thus proposes a safety system comprising, in the gas flow chain between the liquid drive source and the nose piece of the torch, at least one chamber defining an excess volume or capacity such as for example a torch foot tank provided with an overflow column discharging below the level of the sea, at a given distance from its tapping point in said capacity.

Thus, a particularly simple and reliable safety system is obtained possibly completing or even replacing the usual safety systems, and which has the advantage of using no detection device and no mechanical means subject to break-downs.

Thus, in the case of a slow or sudden derangement of the system, the excess liquid will be discharged into the sea with a very low fire risk probability since:

it would require a considerable hot point in the zone where the liquid will reach the surface of the sea to cause ignition thereof, because of the depth at which it is discharged, and because of the sea currents which exist in most sites, the liquid will only rise to the surface at a certain distance from the installations.

Furthermore, the overflow column, in some applications, will be equipped with a device for discharging inside the column different products whose main purposes will be, but not limitatively so, to delay or prevent the liquid hydrocarbons from rising to the surface, reducing, delaying or inhibiting the pollution caused by the hydrocarbons.

Moreover, in some applications, the torch will be equipped with manual or automatic ignition and extinction means allowing the flame to be initiated or blown out in different operating configurations or for safety reasons or similar.

BRIEF DESCRIPTION OF THE DRAWINGS

Embodiments of the invention will be described hereafter, by way of non limiting examples, with reference to the accompanying drawings in which.

DETAILED DESCRIPTION OF THE INVENTION

Figure 1:
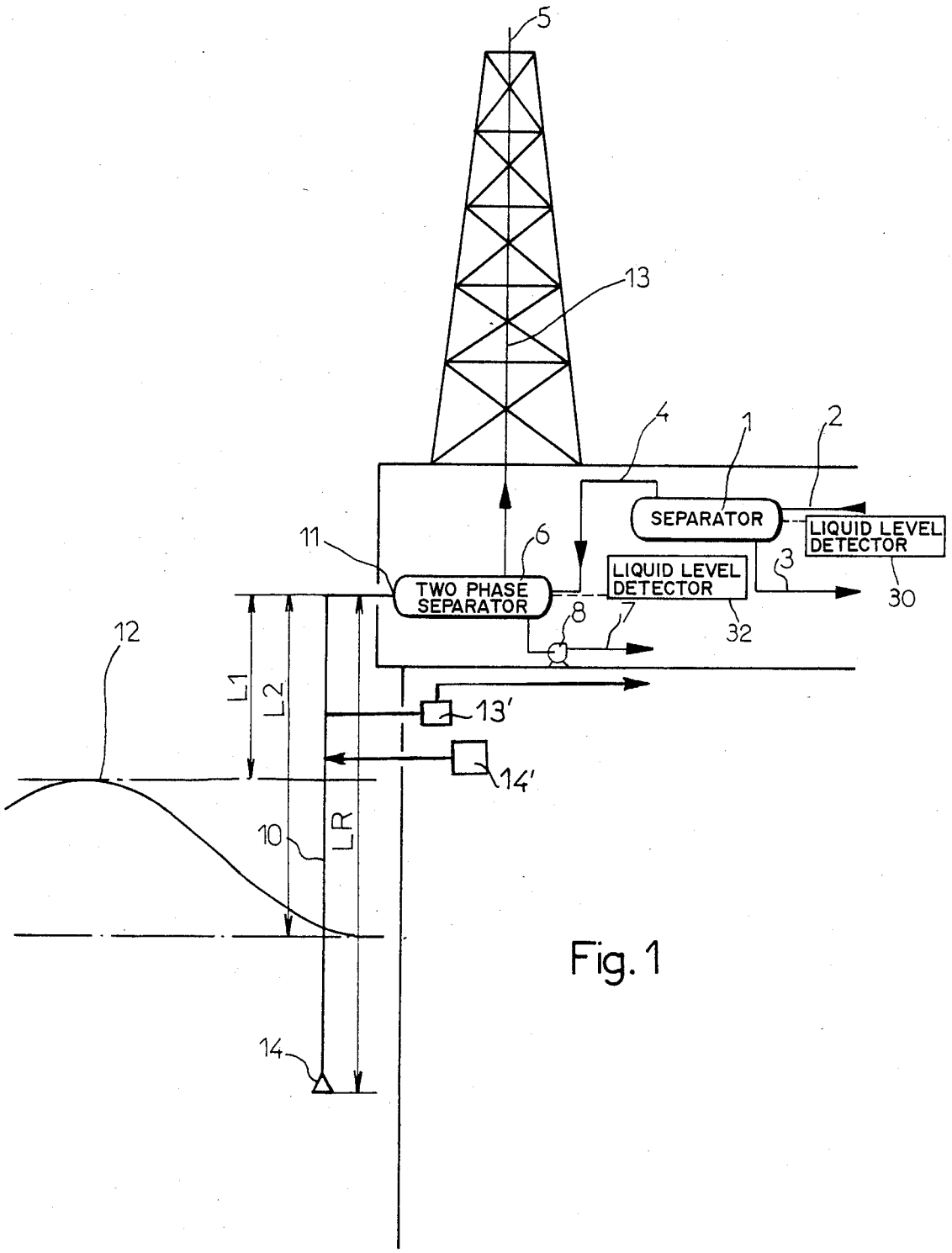
FIG. 1 is a schematical representation of a first production installation equipped with a safety device according to a first embodiment of the invention.

Referring to FIG. 1, the installation comprises first of all a liquid hydrocarbon drive source formed by an intake separator 1 receiving the crude oil or the gas through an intake pipe 2. This separator is equipped conventionally with a normal oil or condensate take-off circuit 3 and a gas outlet connected to a gas flow chain 4 as far as the nose-piece 5 of the torch.

This gas flow chain 4 comprises, between separator 1 and the nose-piece of torch 5, a torch foot tank 6 equipped, in a conventional way, with a droplet take-off circuit 7 comprising a pump 8 or not.

Separator 1 and torch foot tank 6 are both equipped with a high liquid level detection circuit 30, 32 (liquid level detectors) for closing, should the liquid level become abnormally high, the gas or crude oil feed of the installation.

According to the invention, this installation comprises an overflow column 10 tapped (tapping 11) on the torch foot tank 6 at a position corresponding to a maximum predetermined level emerging below the level 12 of the sea at a distance $L_R$ below the tapping 11 on said tank 6.

This overflow column 10 is equipped with a discharge conduit opening or device 14' and means 13' for removing liquid hydrocarbons overflowing in the overflow column so as to reinsert them into the normal treatment circuits. These take-off means will be formed, for example, by different types of pumps or liquid or gas ejectors (gas lift). They may be positioned during construction of the installation or later and they may be removable or not.

Thus, under normal operating conditions, the two level detection systems will inform the operators of a malfunction and will turn off the crude oil intake if the malfunction has not been corrected.

Should a sudden derangement and non operation of the two level detection circuits occur, the liquids will be discharged into the sea through the overflow column 10, the torch continuing to be fed with gas, until the defect has been corrected or unitl the crude oil intake has been closed manually or automatically.

Figure 2:
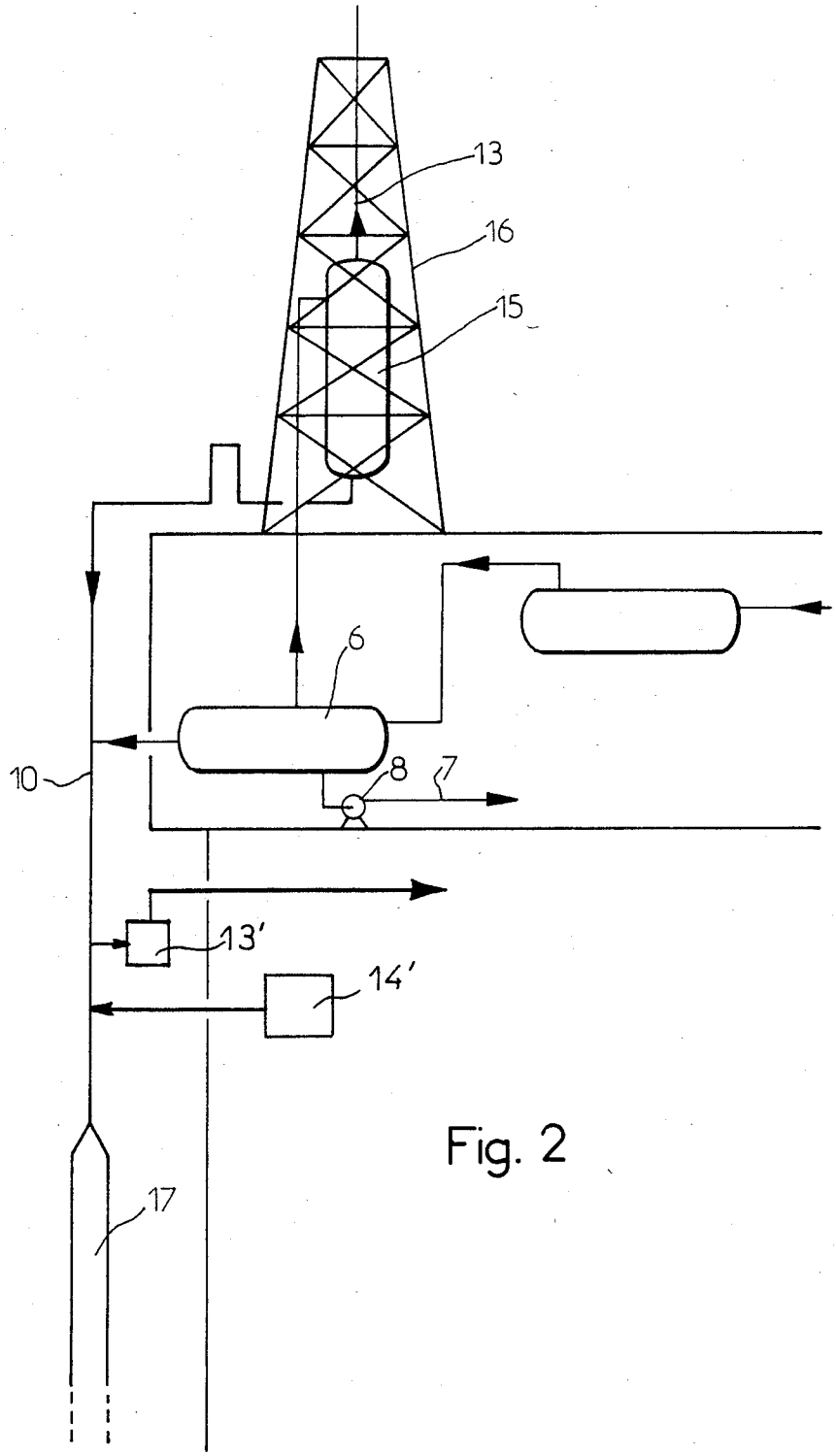
FIG. 2 is a schematical representation of a second installation requiring less space and equipped with anti-pollution means.

Thus a circuit is obtained of very high safety. However, because of the dimensions of the torch foot tank 6, it presents a considerable disadvantage (which may be eliminated by means of the arrangements which will be described more especially with reference to FIGS. 2 and 3).

It should be stated that, to obtain acceptable operation, the overflow column 10 must satisfy given dimensioning criteria complying with at least two main conditions, namely:

to prevent the liquids rising in the torch barrel 13, should choking occur;

to prevent gas leaving through the lower end 14 of the overflow column 10 during normal service.

These conditions may be expressed as follows:

(A) To avoid choking up of the torch foot tank 6 or the rise of liquids in barrel 13, the flow of liquids into the sea should be ensured, which implies that the following equation (1) is at least satisfied, without taking into consideration the different pressure drops in the ducts:

$$P_1+(L_1\times d_o)9.81 \geqq P_{atm}+(L_R-L_1)(d_w-d_o)9.81 \quad (1)$$

in which:

$L_1$ is the height of the tapping 11 with respect to the highest level of the sea (expressed in m);

$L_R$ is the length of the overflow column 10 (expressed in m);

$P_1$ is the pressure inside the torch foot tank 6 (expressed in $P_a$);

$P_{atm}$ is the atmospheric pressure (in $P_a$);

$d_o$ is the voluminal mass of the liquid (in $Kg/m^3$ at $T_1°$;

$d_w$ is the voluminal mass of the sea water ($kg/m^3$ at $T_2°$).

The most unfavorable conditions being reached when $P_1=P_{atm}$ (the case of stopping after choking up and total filling with liquid of the overflow column 10 over the length $L_R$), the relationship (1) may be simplified to:

$$L_1\times d_o \geqq (L_R-L_1)(d_w-d_o) \quad (2)$$

Applications (1) For $d_w=1020$ $d_o=700$ (imperfectly degasified oil)

$L_R=50$ m the minimum height $L_1$ is 15.7 m (example 1)

(2) Under the same conditions as above but with a better degasified oil of $d_o=800$, the height $L_1$ becomes 10.8 m (example 2).

(3) Under the same conditions as in example 1 but with a shorter overflow column 10, $L_R=40$ m, the minimum height $L_1$ is 12.5 m (example 3).

(4) Under the same conditions as in example 3 but with an oil density $d_o=800$, the minimum height $L_1$ becomes=8.62 m (example 4).

(B) To prevent gas leaving through the lower end of the overflow column 10, the following relationship should be confirmed:

$$9.81(L_R-L_2)d_w+P_{atm} \geqq P_1 \quad (3)$$

In which $L_2$ is the height of the tapping with respect to the lowest level of the sea (expressed in m).

Applications (1) with $d_x=1020$ $L_R=50$ m $L_2=30$ m $P_{atm}=1.013\times 10^5 P_a$ the pressure $P_1$ should be less than $3.013\times 10^5 P_a$.

(2) with $d_x=1020$ $L_R=40$ m $L_2=30$ m $P_{atm}=1.013\times 10^5 P_a$ the pressure $P_1$ should be less than $2.013\times 10^5 P_a$.

It follows, from an examination of the preceding relationships 1 and 3, that the safety system prposed will not be applicable in all cases, and in particular in water depths which are too shallow.

If, for a given set-up, the relationships 1 and 3 are confirmed with reasonable safety coefficients, and if the dimensioning of the ducts is correct to take into account the different pressure drops, the risk of the torch being choked up is very unlikely.

However, the risk of liquid being carried to the nosepiece of torch 5 remains, except if the torch foot tank 6 is designed and sized as a gas-liquid (two phase) separator in one possible embodiment, operating at a very low level. This leads to the use of a tank 6 whose dimensions and weight risk being prohibitive.

Moreover, since the oil/gas separation takes place without real control, in the torch foot tank 6 where the internals are practically excluded, the risk of carrying along droplets of liquid remains high.

An examination of relationships 1 and 3 shows that the increase in dimensions $L_1$ and $L_R$ leads to an improvement in safety.

Pollution

Should choking up occur, whether the installation comprises this safety system or not, the amount of liquids discharged into the sea will be substantially the same.

Nevertheless, for choking up of limited duration, the volume of liquid "trapped" in the overflow column may be raised in the installations and discharged. However, the danger of inopportune ignition of liquid hydrocarbons is considerably less than when directly discharged in the sea.

In FIG. 1, the liquids are discharged into the sea "like a spring", that is to say that it will need a considerable hot point in the zone where the liquid hydrocarbons will reach the surface of the sea to cause ignition thereof. However, taking into consideratioon the sea currents which may exist on a good number of sites, the liquid hydrocarbons will only come to the surface at a remote distance from the installations.

By way of example, for an overflow column 10 discharging at 50 m below the mean level of the water and with oil of voluminal mass 850, this oil will only come to the surface at about 60 m from the vertical of column 10 for a current of 0.25 knot.

Effect of the waves

The level of the water inside the overflow column 10 will follow with a delay and damping the level of the water on the outside. However, this point should be confirmed so as to avoid air intakes into the torch barrel 13, especially in the case of short overflow columns 10 and small gas flows. As a general rule, the longer the overflow column 10, the less will be the effect of the waves.

To take into account the points mentioned above, an arrangement (FIG. 2) is developed as follows:

The torch foot tank 6, generally placed at a low point of the installation, during normal service is used to remove accumulated liquid (circuits 7,8). Its dimensions and its weight become acceptable again. It is completed by a liquid/gas separator 15 placed at the lower part of the torch barrel 13, this latter only being useful should choking up occur.

This separator 15 may be housed in the tower 16 supporting the torch. It operates at a very low level and at low pressure.

From a certain depth, the overflow column 10 may possibly be expanded to form an additional retention volume 17, thus avoiding any pollution for a limited period of time. The liquid hydrocarbons thus trapped may be subsequently reinserted into the installations by means 13.

The lower part of column 10 may be fitted with lateral strainers so as to better disperse the liquid hydrocarbons into the sea.

Figure 3:
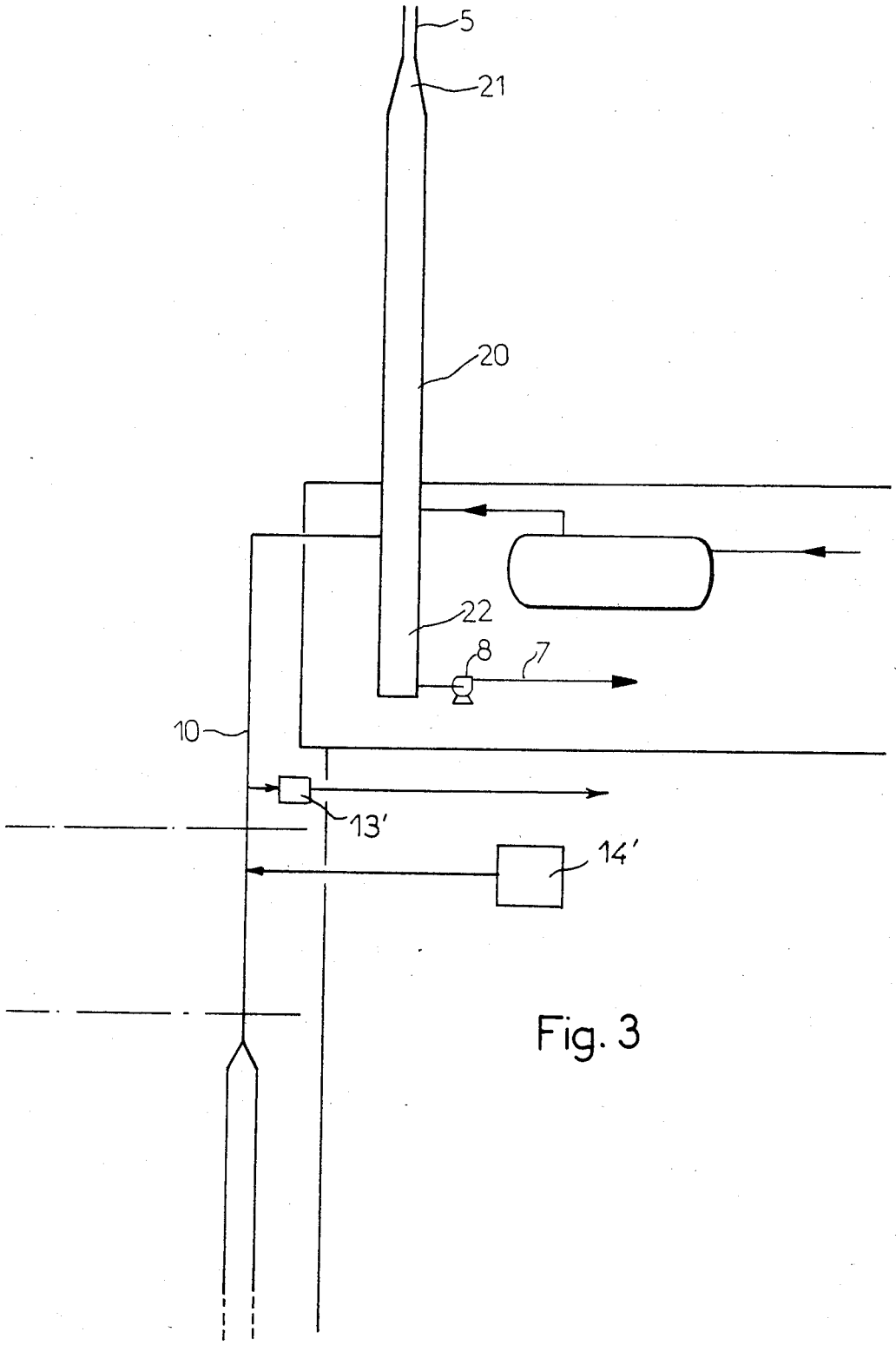
FIG. 3 is a schematical representation of a third installation in which the barrel of the torch serves as torch foot tank.

Finally, for some applications, the embodiment shown in FIG. 3 presents a simplified solution.

The vertical torch barrel 20 is formed by a tube of variable section or not, being possibly for some applications self-resistant to external forces, and having a diameter such that the rise speed of the gas is sufficiently low for the gas/liquid separation to take place. The speeding up of the gas may be provided if necessary at the torch nose-piece 5 by passing through a reduced tubular section 21 or by any other means.

The lower end 22 of the torch barrel serves as torch foot tank under normal operating conditions, and is equipped with an overflow column 10 such as those previously described as well as a droplet take-up circuit 7, 8 and 13'.

An additional simplification will consist for some applications in constructing the overflow column-torch barrel assembly as a continuous tubing with possibly variable section, the droplet take-up circuit being then installed at a suitable height on the continuous tubing.

Furthermore, in all the installation configurations of this safety system, this latter may use, for its construction, already existing tube parts, made from steel or other materials such as concrete, and able to fulfil other functions such as supporting the installations. The support thereof may also be provided by means of frames or supports required or not for fulfilling other functions.

I claim:

1. A system for safely burning hydrocarbon gases given off by the production or treatment of hydrocarbons, by preventing the accidental burning of hydrocarbon liquids which might become entrained in the hydrocarbon gases stream being burned, comprising:

a. a gas-liquid separator chamber for separating gas hydrocarbons from liquid hydrocarbons;

b. an overflow column connected to said gas-liquid separator chamber at a given liquid overflow level which is above a normal liquid fuel level, such that when the liquid hydrocarbon level in said separator chamber reaches the overflow level, the liquid hydrocarbons flow through the overflow column to a discharge end located at a given distance from the gas-liquid separator chamber and beneath the surface of a body of water at the site of the installation, to be discharged into the water and dissipated thereby; and c. a flare tip, connected through a flare pipe and a gas flow chain to said gas-liquid separator chamber at a location above said liquid overflow level for burning gases separated by said gas-liquid separator chamber, such that the over-flow column prevents liquid from rising to a level at which it might become entrained in the gases flowing to the flare tip to be burned, to prevent the accidental burning of entrained liquid hydrocarbons with the hydrocarbon gases.

2. The system according to claim 1, characterized by an intake gas-liquid separator (1) for receiving hydrocarbons through an intake duct (2) and equipped with a liquid take-up means (3) for removing liquid separated by said intake gas-liquid separator, said gas-liquid separator chamber (6) being located at the base of said flare pipe and being coupled to a gas flow outlet (4) of said intake gas-liquid separator (1), which can possibly carry therethrough some liquid hydrocarbons entrained in the hydrocarbons gases, and also being equipped with a liquid take-up means (7) for removing liquid separated by said gas-liquid separator chamber.

3. The system according to claim 2, characterized in that said intake gas-liquid separator (1) and said gas-liquid separator chamber (6) are each respectively equipped with a high liquid level detection circuit for shutting off the feed input through the intake duct to said intake gas-liquid separator if the detected liquid level is abnormally high.

4. The system according to claim 2, characterized in that said gas-liquid separator chamber (6) is placed at a low point of the installation, and a gas outlet therefrom is connected to a further gas-liquid separator (15) placed in the lower part of the flare pipe (13) in a tower (16) supporting the flare tip.

5. The system according to claim 1, characterized in that the overflow column (10) is expanded to form a retention capacity and in that the lower part of said column is fitted with lateral strainers so as to better disperse the liquid hydrocarbons beneath the surface of the water.

6. The system according to claim 1, wherein said overflow column includes means for delaying the release of liquid hydrocarbons into the body of water thereby delaying the rise of the liquid hydrocarbons to the surface of the body of water.

7. The system according to claim 1, wherein said flare pipe (20) leading to the flare tip has a diameter such that the rise speed of the gas is sufficiently slow for gas/liquid separation to be able to take place, in that a speeding up of the gas occurs at the flare tip (5) by passing the gas through a reduced tubular section (21) and in that the lower end (22) of the flare pipe serves as said gas-liquid separator chamber and is connected to said overflow column (10).

8. The system according to claim 7 characterized in that the flare pipe (20) and the overflow column are formed as one tube having variable cross sections.

9. The system according to claim 1, installed on land on a fixed support.

10. The system according to claim 1, wherein said system is installed in an off-shore support, and the body of water is the off-shore water surrounding the support, such that the liquid is discharged beneath the surface of the surrounding water to be dissipated thereby.

* * * * *